US011751702B2

(12) United States Patent
Lilja

(10) Patent No.: US 11,751,702 B2
(45) Date of Patent: Sep. 12, 2023

(54) SHELVING DISPLAY

(71) Applicant: Menasha Corporation, Neenah, WI (US)

(72) Inventor: Chad M. Lilja, Farmington, MN (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 17/454,372

(22) Filed: Nov. 10, 2021

(65) Prior Publication Data

US 2022/0378227 A1 Dec. 1, 2022

Related U.S. Application Data

(60) Provisional application No. 63/192,851, filed on May 25, 2021.

(51) Int. Cl.
*A47F 5/11* (2006.01)

(52) U.S. Cl.
CPC ..... *A47F 5/116* (2013.01)

(58) Field of Classification Search
CPC .. A47F 5/116; A47F 5/11; A47F 5/112; A47F 5/0018; A47B 47/06; A47B 55/06
USPC ..... 211/135, 72
See application file for complete search history.

(56) References Cited

U.S. PATENT DOCUMENTS 1,827,008 A 10/1931 Huckel
1,912,847 A 6/1933 Earl
1,964,880 A 7/1934 Katz
1,992,373 A 2/1935 Johnson
2,018,707 A 10/1935 Daller
D104,437 S 5/1937 Bulman
2,150,743 A 3/1939 Mancuso
2,307,992 A 1/1943 Calhoun et al.
2,339,656 A 1/1944 Shina
D146,386 S 2/1947 Shield
(Continued)

FOREIGN PATENT DOCUMENTS

CA 3076091 A1 9/2020
CA 3113145 A1 9/2021
(Continued)

OTHER PUBLICATIONS

Leblanc, Rick, "Limits on Export Pallets Creating Corrugated Window of Opportunity; Corrugated Pallet Suppliers Experiencing Renewed Interest for Expert, Domestic Markets," http://www.palletenterprise.com/articledatabase/view.asp?articleID-648; 4 pages; Apr. 1, 2002.
(Continued)

*Primary Examiner* — Jennifer E. Novosad
(74) *Attorney, Agent, or Firm* — Richard C. Himelhoch; Greensfelder, Hemker & Gale, P.C.

(57) ABSTRACT

A shelving display formed from a corrugated material which includes a back wall panel, a first side wall panel, a second side wall panel and a front wall panel having a plurality of shelves hingedly attached to the front wall panel. The shelving display includes a pull down panel that is connected to each of the plurality of shelves. The display is easily assembled in two-steps on site. In a first step, the panels are unfolded from a flat state to have a rectangular cross-sectional shape. In the second step, the pull down panel is used to pull the shelves into position.

17 Claims, 5 Drawing Sheets

(56) References Cited

U.S. PATENT DOCUMENTS

D153,188 S 3/1949 Stensgaard
D158,775 S 5/1950 Malkin
D158,776 S 5/1950 Malkin
2,666,531 A * 1/1954 Anderson, Jr. ..... A47F 5/112 108/99
2,706,066 A 4/1955 Wells
2,743,021 A 4/1956 Glenn
2,798,685 A 7/1957 Mooney
2,884,179 A 4/1959 Rossum
2,918,178 A 12/1959 Leone
2,944,555 A 7/1960 Peel et al.
2,975,890 A 3/1961 Block
2,997,222 A 8/1961 Sperry
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,362,610 A 1/1968 Van Dyke
3,480,196 A 11/1969 De Simas
3,514,031 A 5/1970 Burgess
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,889,867 A 6/1975 Berg
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,271,766 A 6/1981 Schmiedeler
4,283,000 A 8/1981 White
4,292,901 A 10/1981 Cox
4,311,100 A 1/1982 Gardner et al.
4,375,874 A 3/1983 Leotta et al.
4,376,558 A 3/1983 Bandar
4,493,424 A 1/1985 Smith
4,503,973 A 3/1985 Andersson
4,506,790 A 3/1985 Muscari
D278,493 S 4/1985 Brescia et al.
4,512,541 A 4/1985 Lietzke
4,570,805 A 2/1986 Smith
4,602,735 A 7/1986 Aaron
4,610,355 A 9/1986 Maurer
4,618,115 A 10/1986 Belokin, Jr.
4,630,740 A 12/1986 Belokin, Jr.
4,646,922 A 3/1987 Smith
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Howard et al.
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,899,929 A 2/1990 Grollman
4,911,084 A 3/1990 Sato et al.
4,911,311 A 3/1990 Nagai
4,936,470 A 6/1990 Prindle
D321,100 S 10/1991 Dorrell
D321,295 S 11/1991 Nuebier
D321,615 S 11/1991 Lavine et al.
5,067,418 A 11/1991 Carter
5,119,740 A 6/1992 Carter
5,125,520 A 6/1992 Kawasaki
5,141,105 A 8/1992 Maye
5,176,265 A 1/1993 Bennett
D332,883 S 2/1993 Staude
5,183,166 A 2/1993 Belokin, Jr. et al.
5,195,440 A 3/1993 Gottlieb
5,213,220 A 5/1993 McBride
5,259,631 A 11/1993 Brande
5,269,219 A 12/1993 Juvik-Woods
5,272,990 A 12/1993 Carter
5,315,936 A 5/1994 Smith
D349,202 S 8/1994 Eliadis et al.
5,335,593 A 8/1994 Stoddard et al.
D351,076 S 10/1994 Eliadis et al.
5,357,875 A 10/1994 Winebarger et al.
5,388,531 A 2/1995 Crews et al.
5,413,053 A 5/1995 Vannatta
5,427,019 A 6/1995 Moorman
5,443,168 A 8/1995 Dyment et al.
D362,768 S 10/1995 Lechleiter et al.
5,458,411 A 10/1995 Moss
D363,840 S 11/1995 Weshler
5,465,672 A 11/1995 Boyse et al.
5,465,851 A 11/1995 Smith
5,487,344 A 1/1996 Hutchinson
5,487,345 A 1/1996 Winebarger
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,630,518 A 5/1997 Collins
5,669,683 A 9/1997 Moss et al.
5,672,412 A 9/1997 Phares et al.
5,678,492 A 10/1997 Pinkstone et al.
5,685,234 A 11/1997 Grigsby et al.
D388,905 S 1/1998 Wells
5,706,953 A 1/1998 Polvere
5,706,959 A 1/1998 Smith
5,711,423 A 1/1998 Fuller, Jr.
D395,534 S 6/1998 Besaw
5,758,783 A 6/1998 Maglione
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,098,820 A 8/2000 Smith
6,126,131 A 10/2000 Tietz
6,126,254 A 10/2000 Maglione
6,135,030 A 10/2000 Besaw
D433,782 S 11/2000 Carter
D433,839 S 11/2000 Culbertson

(56) References Cited

U.S. PATENT DOCUMENTS 6,145,671 A 11/2000 Riga et al.
6,145,794 A 11/2000 Smith
6,164,215 A 12/2000 Cook et al.
6,189,778 B1 2/2001 Kanter
6,302,283 B1 10/2001 Yeh
D453,057 S 1/2002 Sewell
6,354,229 B1 3/2002 Heidtke
6,357,587 B1 3/2002 Melms, Jr.
6,360,465 B1 3/2002 Simpson
6,378,710 B1 4/2002 Grueneberg
6,394,003 B1 5/2002 Lacy, III
6,394,290 B1 5/2002 Walsh et al.
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,612,669 B2 9/2003 Grueneberg
6,659,295 B1 12/2003 De Land et al.
6,715,623 B2 4/2004 Broerman
6,729,484 B2 5/2004 Sparkowski
6,752,280 B2 6/2004 Dye
6,758,352 B2 7/2004 Gervasi
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Raile
6,951,300 B2 10/2005 Caille et al.
6,966,447 B2 11/2005 Hiltke et al.
7,007,615 B2 3/2006 Grueneberg
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute, II et al.
7,111,735 B2 9/2006 Lowry
7,137,517 B2 11/2006 Lowry et al.
D533,734 S 12/2006 Campbell
7,191,906 B1 3/2007 Pinco
7,234,604 B2 6/2007 Eisele
7,252,200 B1 8/2007 Hester
D566,989 S 4/2008 Mason
D576,426 S 9/2008 Yuen-Schat et al.
D578,804 S 10/2008 Norman et al.
7,546,926 B2 6/2009 Stolle et al.
7,546,927 B2 6/2009 Lowry et al.
7,571,820 B2 8/2009 Alexander
D603,189 S 11/2009 Raile
7,650,996 B2 1/2010 Mark
7,677,433 B2 * 3/2010 Little ..... B65D 5/526 229/120.31
7,703,665 B2 4/2010 McGowan
7,703,864 B2 * 4/2010 Moser ..... B65D 5/5213 312/261
7,717,265 B2 5/2010 Honkawa et al.
7,726,474 B2 6/2010 Berger et al.
7,828,169 B2 11/2010 Robinson et al.
7,882,966 B2 2/2011 Field et al.
7,905,365 B2 3/2011 Virvo
7,992,716 B2 8/2011 Jackson
8,002,171 B2 8/2011 Ryan et al.
8,141,713 B2 * 3/2012 Farkas ..... B65D 5/722 206/762
8,157,112 B2 4/2012 Bojie
8,317,039 B2 11/2012 Norman
8,485,370 B2 7/2013 Dewhurst
8,651,297 B2 2/2014 Beaty
8,857,633 B2 10/2014 Dewhurst
8,985,328 B2 3/2015 Slaats
9,045,250 B2 6/2015 Henderson et al.
9,198,508 B1 12/2015 Kufel
9,211,021 B2 12/2015 Smith
9,428,298 B2 8/2016 Bersamin et al.
9,474,389 B2 10/2016 Pfeifer et al.
9,487,321 B2 11/2016 Luke
9,743,783 B1 * 8/2017 Bersamin ..... A47F 5/116
9,844,282 B2 * 12/2017 Smith ..... A47B 43/02
9,907,414 B2 3/2018 Heuer
9,918,569 B1 * 3/2018 Abel ..... B65D 5/5213
9,919,829 B2 3/2018 Jolley
9,938,040 B2 4/2018 Buscema
9,969,523 B2 5/2018 Ayerst
10,117,529 B2 * 11/2018 Abel ..... A47F 5/116
10,123,635 B2 * 11/2018 Lilja ..... A47B 43/02
10,159,362 B2 12/2018 Smith
10,306,999 B2 6/2019 Smith
10,315,798 B2 6/2019 Pfeifer et al.
10,448,758 B1 * 10/2019 Abel ..... A47F 5/116
10,463,176 B1 11/2019 Sells
10,470,591 B1 11/2019 Heiden et al.
10,524,588 B2 1/2020 Pratsch
10,524,589 B2 1/2020 Donegan
10,531,750 B1 1/2020 Heiden et al.
10,568,422 B2 * 2/2020 Gibbons, Jr. ..... A47F 5/116
10,568,439 B2 * 2/2020 Bersamin ..... A47F 5/116
10,888,180 B2 1/2021 Robinson
10,905,260 B2 2/2021 Hara et al.
10,973,317 B2 4/2021 Gibbons, Jr. et al.
11,019,943 B2 6/2021 Burgert et al.
11,033,120 B2 6/2021 Frost
11,154,145 B1 10/2021 Pfeifer
2002/0189507 A1 12/2002 Benner
2003/0042828 A1 3/2003 Bonin
2003/0042829 A1 3/2003 Bonin
2003/0111383 A1 6/2003 Qiu et al.
2004/0148825 A1 * 8/2004 Myers ..... A47F 5/116 40/124
2004/0195195 A1 10/2004 Mason
2005/0252872 A1 11/2005 Eisele
2005/0274684 A1 12/2005 Swanson
2006/0006096 A1 1/2006 Funk
2006/0261025 A1 11/2006 Heyderman et al.
2006/0283775 A1 12/2006 Mark
2007/0193479 A1 8/2007 Slaats
2007/0272639 A1 11/2007 Alexander
2008/0169339 A1 * 7/2008 Moser ..... B65D 5/5213 229/108.1
2008/0169340 A1 7/2008 Sheffer
2008/0173602 A1 7/2008 Field et al.
2008/0265726 A1 * 10/2008 Sheffer ..... A47B 47/06 493/56
2009/0107940 A1 4/2009 Norman et al.
2009/0127150 A1 5/2009 Meers
2010/0006529 A1 * 1/2010 Groff ..... A47F 5/116 211/186
2010/0025344 A1 2/2010 Virvo
2010/0133215 A1 6/2010 Norman
2011/0000955 A1 1/2011 Manteufel et al.
2011/0049072 A1 3/2011 Dewhurst
2011/0266177 A1 11/2011 Lowry et al.
2012/0074037 A1 3/2012 Orischak et al.
2012/0261367 A1 * 10/2012 Kabakci ..... A47F 5/116 211/59.2
2012/0305512 A1 12/2012 L'Hotel
2013/0097903 A1 4/2013 Gerstner
2013/0213915 A1 * 8/2013 Pfeifer ..... A47F 5/116 211/195
2013/0264923 A1 * 10/2013 Brady ..... A47B 43/003 312/258
2013/0277324 A1 10/2013 Dewhurst
2014/0217047 A1 8/2014 Frost
2015/0041420 A1 2/2015 Zelek et al.
2015/0136720 A1 5/2015 Miller
2016/0066711 A1 3/2016 Mestres Armengol et al.
2016/0198870 A1 7/2016 Volz et al.
2017/0079449 A1 3/2017 Smith
2017/0086604 A1 3/2017 Goldsmith et al.
2017/0295927 A1 10/2017 Gibbons, Jr. et al.
2018/0042405 A1 2/2018 Lilja
2018/0070747 A1 3/2018 Smith
2018/0092461 A1 4/2018 Brady et al.
2018/0130382 A1 5/2018 Hinch et al.

(56) References Cited

U.S. PATENT DOCUMENTS

| | | | | |
|---|---|---|---|---|
| 2018/0146803 | A1 | 5/2018 | Urban | |
| 2018/0160825 | A1 | 6/2018 | Abel | |
| 2018/0289178 | A1 | 10/2018 | McMillan-Sweat et al. | |
| 2019/0008290 | A1 | 1/2019 | Ertl | |
| 2019/0069694 | A1 | 3/2019 | Smith | |
| 2019/0150611 | A1 | 5/2019 | Burnett | |
| 2019/0380513 | A1 | 12/2019 | Frost | |
| 2020/0037787 | A1 | 2/2020 | Pratsch | |
| 2020/0077816 | A1 | 3/2020 | Doane | |
| 2020/0113355 | A1 | 4/2020 | Hara et al. | |
| 2020/0221866 | A1 | 7/2020 | Dell | |
| 2020/0260866 | A1 | 8/2020 | Gibbons, Jr. et al. | |
| 2020/0288881 | A1 | 9/2020 | Burgert et al. | |
| 2020/0297132 | A1* | 9/2020 | Nguyen | A47F 5/116 |
| 2020/0375375 | A1 | 12/2020 | Robinson | |
| 2021/0244178 | A1 | 8/2021 | Gibbons, Jr. et al. | |
| 2021/0298493 | A1 | 9/2021 | Rose | |
| 2021/0307542 | A1 | 10/2021 | Burgert et al. | |
| 2022/0031092 | A1 | 2/2022 | Pfeifer | |

FOREIGN PATENT DOCUMENTS

| | | | |
|---|---|---|---|
| DE | 102006043829 | A1 | 3/2008 |
| DE | 102011116238 | A1 | 4/2013 |
| EP | 0629557 | A1 | 12/1994 |
| FR | 2984705 | A3 | 6/2013 |
| JP | 06278746 | A | 10/1994 |
| WO | 2008127499 | A1 | 10/2008 |

OTHER PUBLICATIONS

"Solid Wood Packing Materials to Argentina;" http://www.corrugatedprices.com/pallets/swang.html; 2 pages; Feb. 5, 2002. Note: Applicant was unable to locate this reference; however, it believes that a copy is available to the Examiner in the application file for U.S. Appl. No. 12/621,221 at the U.S. Patent and Trademark Office.

* cited by examiner

SHELVING DISPLAY

CROSS-REFERENCE TO RELATED APPLICATIONS

The present invention claims priority to and the benefit of U.S. Provisional Patent Application No. 63/192,851 filed May 25, 2021, the contents of which are incorporated herein by reference and made a part hereof.

FEDERALLY SPONSORED RESEARCH OR DEVELOPMENT

N/A

FIELD OF THE INVENTION

The present invention is generally directed to a shelving display that can be easily assembled on site, and more particularly, to a shelving display formed from a blank of corrugated material that can be set up in two steps.

DESCRIPTION OF THE PRIOR ART

There are a number of corrugated paper displays having shelves. The displays are typically folded and glued from an initial blank of material. Such displays can be set up at point of purchase locations and then discarded or recycled after use.

One similar display is shown in U.S. Pat. No. 10,123,635 owned by the current Applicant. The display shown includes special support structure for each of the shelves in the display.

Typically, such displays are shipped flat (i.e., unassembled) and are then assembled on site. This can take some time, especially if portions of the display need to be glued (and were not already pre-glued prior to shipping). The present invention provides a display that can be shipped flat and then easily assembled in two steps.

SUMMARY OF THE INVENTION

The present invention is directed to a two-step display formed from a corrugated material. The display includes shelves that can be folded downward by a pull down panel to quickly assemble the display.

In accordance with one aspect of the invention, a two-step display is provided. The display comprises a back wall panel, a first side wall panel, a second side wall panel, and a front wall panel having a plurality of shelves hingedly attached to the front wall panel. The display also includes a pull down panel connected to each of the plurality of shelves on the front wall panel. Downward movement of the pull down panel forces each of the plurality of shelves to pivot toward the back wall panel. The pull down panel includes a handle opening to enable a user to pull the shelves into position.

The pull down panel is glued to each of the plurality of shelves. However, the pull down panel can be alternatively secured to the shelves. For example, it can be stapled to the shelves, or structurally connected—such as by a slot and/or tab configuration. The pull down panel has a length shorter than a length of the first side wall and is maintained in the interior of the display when assembled.

Each of the plurality of shelves includes a glue tab. The glue tab can be used to secure the shelves to the back wall panel.

The back wall panel, the first side wall panel, the second side wall panel and the front wall panel can be formed from a single sheet of material. Additionally, the pull down panel can be detachably part of the single sheet of material. However, the pull down panel can be formed separately. The material can be a corrugated paper or plastic, or other similar or suitable materials.

The display can further include a glue strip panel for connecting the second side wall panel to a first side of the back wall panel to create a loop including the side walls, the back wall and the front wall. The loop can be flattened at two opposing fold lines of the display and then formed into shape having a rectangular (e.g., a square) cross-sectional shape or footprint during assembly of the display. In this regard, the back wall panel can be connected to the second side wall panel by a fold line on a second side of the back wall panel. Other fold lines can be formed between panels of the display.

The first side wall panel can include a plurality of first side openings. Each of the first side openings are aligned with one of the plurality of shelves in the front wall panel. Similarly, the second side wall panel can include a plurality of second side openings. Again, each of the second side openings are aligned with one of the plurality of shelves in the front wall panel.

The display can further comprise a plurality of upwardly extending panels that are foldable into forming a top of the display. Similarly, downwardly extending panels can be included to form a bottom of the display.

In accordance with another aspect of the invention, a two-step display comprising a back wall panel and a front wall panel having a plurality of shelves hingedly connected to the front wall panel is provided. The display includes a first side wall panel integrally connected to the back wall panel by a first fold line and to the front wall panel by a second fold line and a second side wall panel integrally connected to the front wall panel by a third fold line. A pull down panel connected to each of the plurality of shelves is also included to quickly assemble the display.

The pull down panel can be glued to each of the plurality of shelves, or it can be structurally secured to each of the shelves (e.g., by a slot and tab configuration). The pull down panel includes a handle opening at a first end of the pull down panel.

The display can further comprise a connecting panel integrally connected to the second side wall panel by a fourth fold line. The connecting panel can be glued to an edge of the back wall panel.

The back wall panel, front wall panel, first side wall panel, second side wall panel and pull down panel are formed from single blank of corrugated material. The pull down panel can be detachable from the blank.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
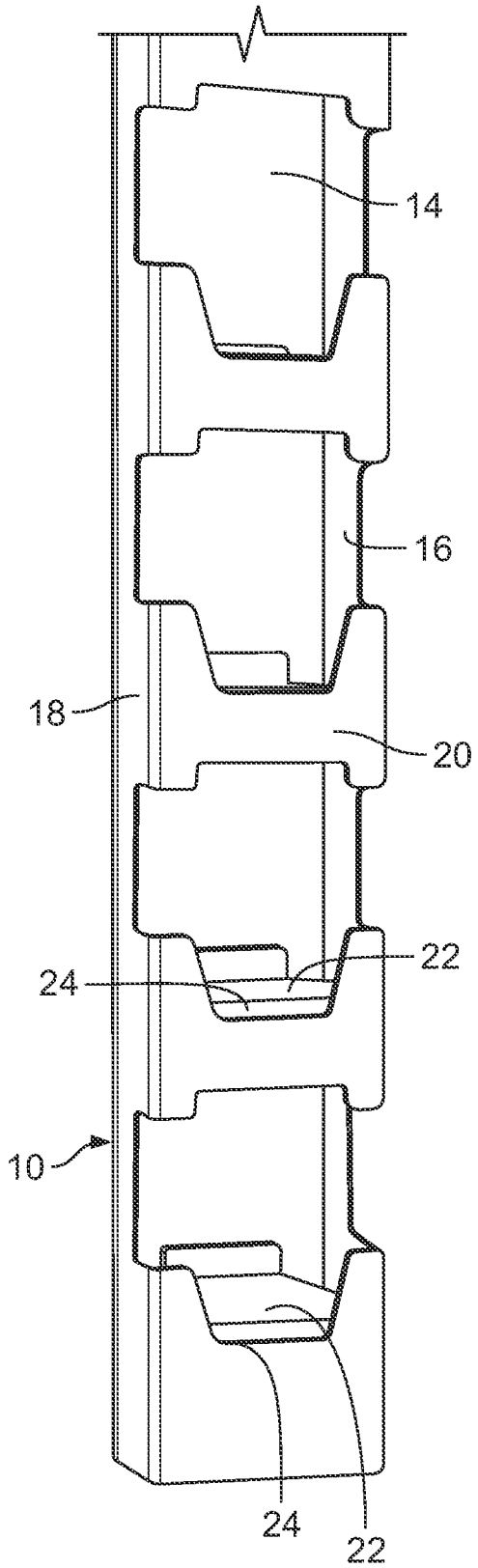
FIG. 1 is a perspective view of an assembled display in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
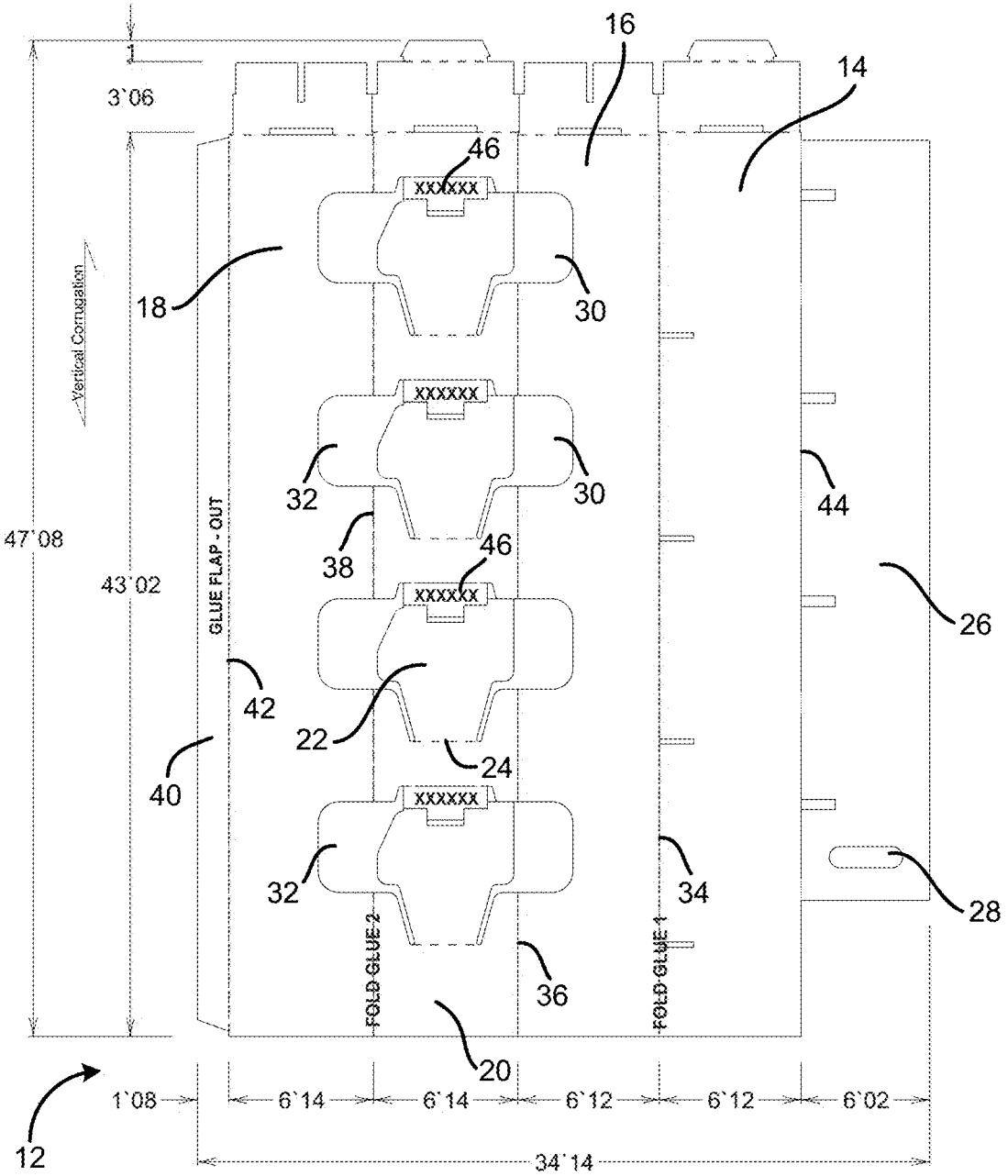
FIG. 2 is a schematic for a blank for forming the display of FIG. 1.

The present invention is directed to a shelving display 10 as shown in FIG. 1. The display 10 is typically formed from a blank 12 of material, such as corrugated paper, corrugated plastic or other similar or suitable materials, that is folded and/or glued at various locations. One such blank 12 for forming the display 10 of FIG. 1 is illustrated in FIG. 2.

The display 10 includes a back wall panel 14, a first side wall panel 16, a second side wall panel 18 and a front wall panel 20. The front wall panel 20 includes a plurality of shelves 22 attached to the front wall panel by a foldable hinge 24.

The display 10 includes a pull down panel 26 to facilitate assembly of the display 10. The pull down panel 26 can be initially formed as a detachable component of the blank 12 as shown in FIG. 2. Alternatively, the pull down panel 26 can be formed separately.

The pull down panel 26 is connected to each of the shelves 22 and is used to pull down each of the shelves, simultaneously, to assemble the display. As illustrated, the pull down panel 26 is shorter than the side wall panels 16, 18, and the back and front wall panels 14, 20 of the display 10. This is because the pull down panel 26 is positioned in the interior of the display 10 and is pulled from a first, unassembled position down to a second, assembled position, and must not stick out of the display in either position. The pull down panel 26 includes a handle opening 28 at a lower end to allow a user to grasp the panel 26 and pull it down to position the shelves in a proper location.

Both the first side wall panel 16 and the second side wall panel 18 include a plurality of openings 30, 32, respectively, aligned with each of the shelves 22. This creates an open effect for the shelving display.

As illustrated in FIG. 2, the blank 12 is arranged so that the back wall panel 14 is integrally connected to the first side wall panel 16 by a first fold line 34. The first side wall panel 16 is also integrally connected to the front wall panel 20 by a second fold line 36. The front wall panel 20 is also integrally connected to the second side wall panel 18 by a third fold line 38.

The blank 12 also includes a thin strip 40 connected to the second side wall panel 18 by a fourth fold line 42. The thin strip 40 is glued to the back wall panel 18 to form a loop with the panels of the display 12. The glued panels can be laid flat with two opposing fold lines open and the other two bent 180 degrees.

As shown, the pull down panel 26 is initially part of the blank 12 and is connected to the back wall panel at 44. However, the pull down panel 26 is detached (e.g., it can be cut from the blank 12, or connected by perforations that can be easily torn) and connected to the shelves (preferably) prior to forming the loop of the remaining panels. Alternatively, the pull down panel 26 can be formed separately (i.e., as not part of the blank 12) and then added to the display panels.

Each of the shelves 22 can include a glue tab 46 that can be glued to the pull down panel 26. Alternatively, the pull down panel 26 can be secured to the shelves in other manners, for example, stapled, folded together, slot and tab, etc., or glued to the shelves at other locations. In such instances, the glue tabs 46 at the top of each shelf 22, can be used to secure the shelf to the back wall panel 14.

Figure 3:
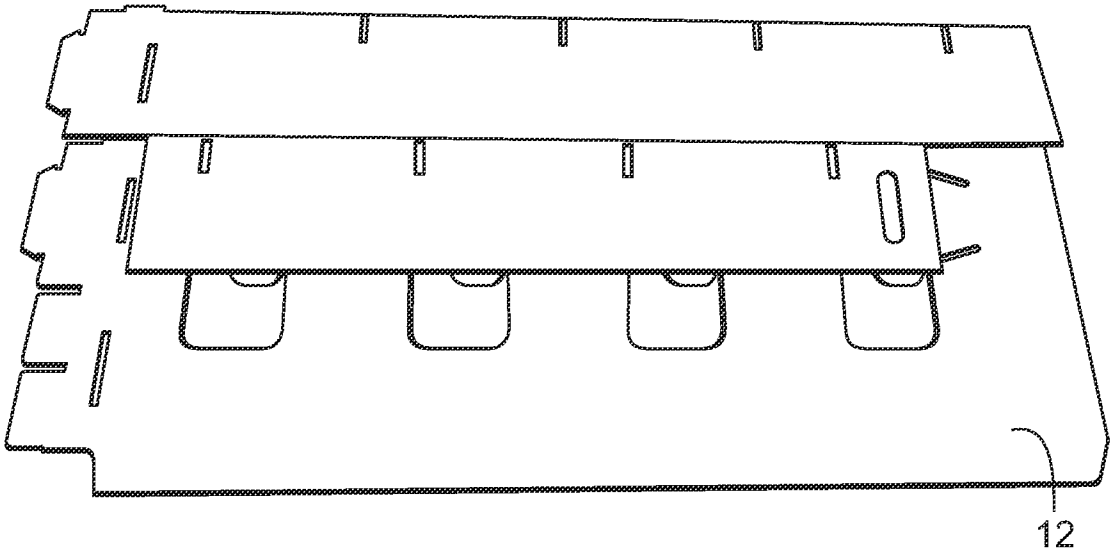
FIG. 3 is a partially folded blank prior to removal of the detachable pull panel.
Figure 4:
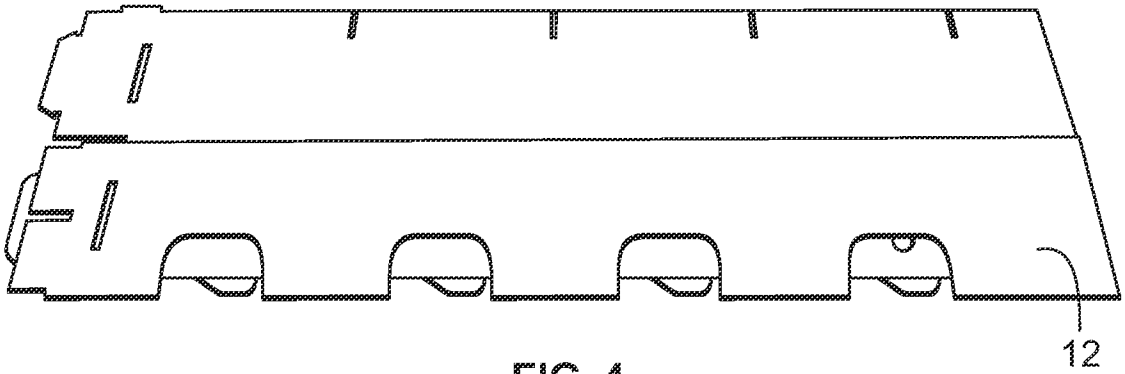
FIG. 4 is a perspective view of a folded blank in a flat form prior to assembly.

FIGS. 3 and 4 illustrate initially forming the loop of panels, and the flat shipping state of the display 12. By shipping the display 12 in a flat, unassembled configuration, a large number of displays can be cost effectively transported.

Figure 5:
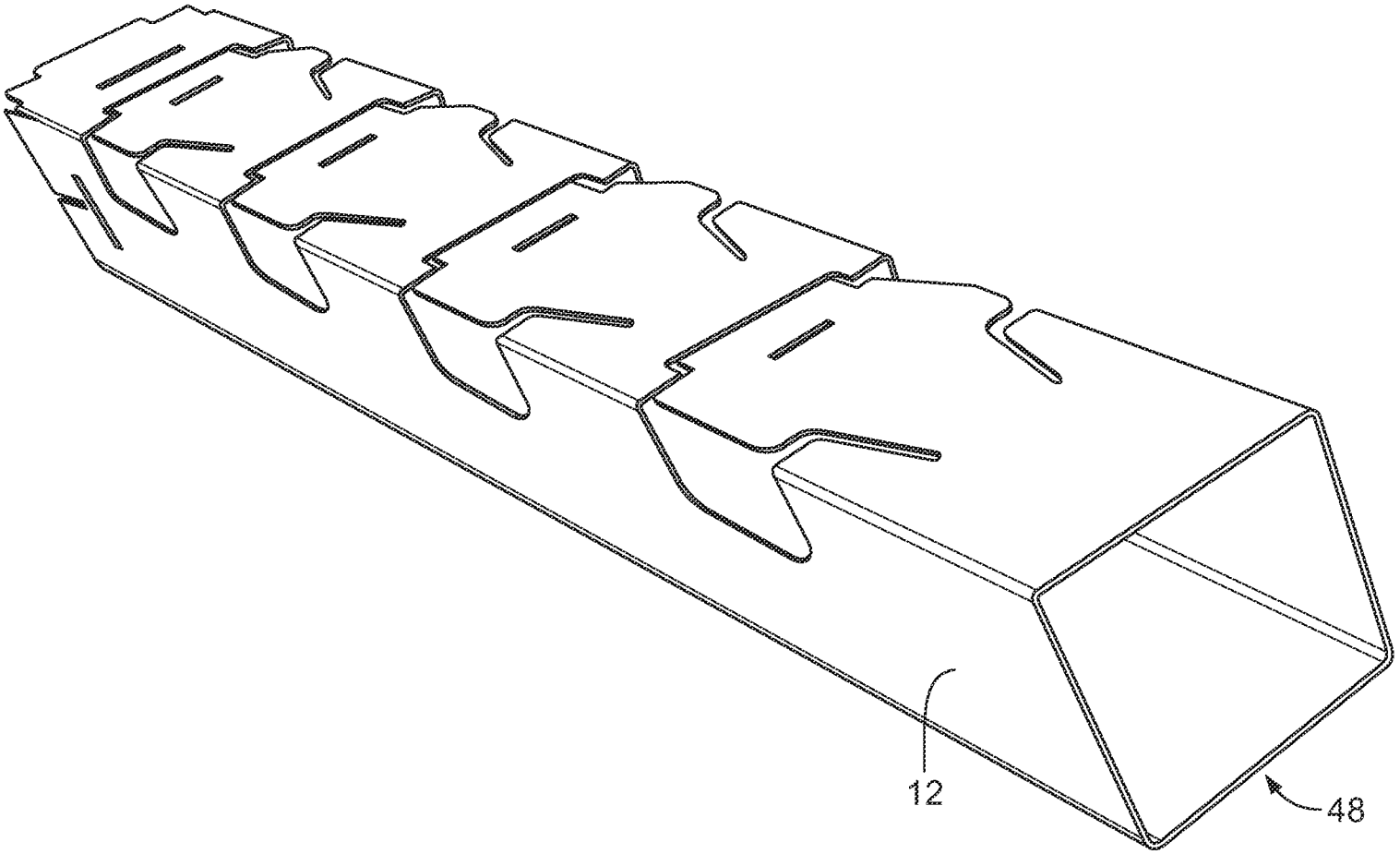
FIG. 5 is a perspective view of a partially assembled display folded to a square cross-sectional configuration in a first step; and, FIG. 6 is a perspective view of the partially assembled display of FIG. 5 with the shelves of the display being placed in position using the pull down panel in a second step.

As illustrated in FIG. 5, to assemble the display 12, a user first opens the flat display by positioning each of the panels at the fold lines at a 90 degree angle. This creates a substantially rectangular cross-section (in this case square) 48 as shown in the open bottom of the display 12.

Figure 6:
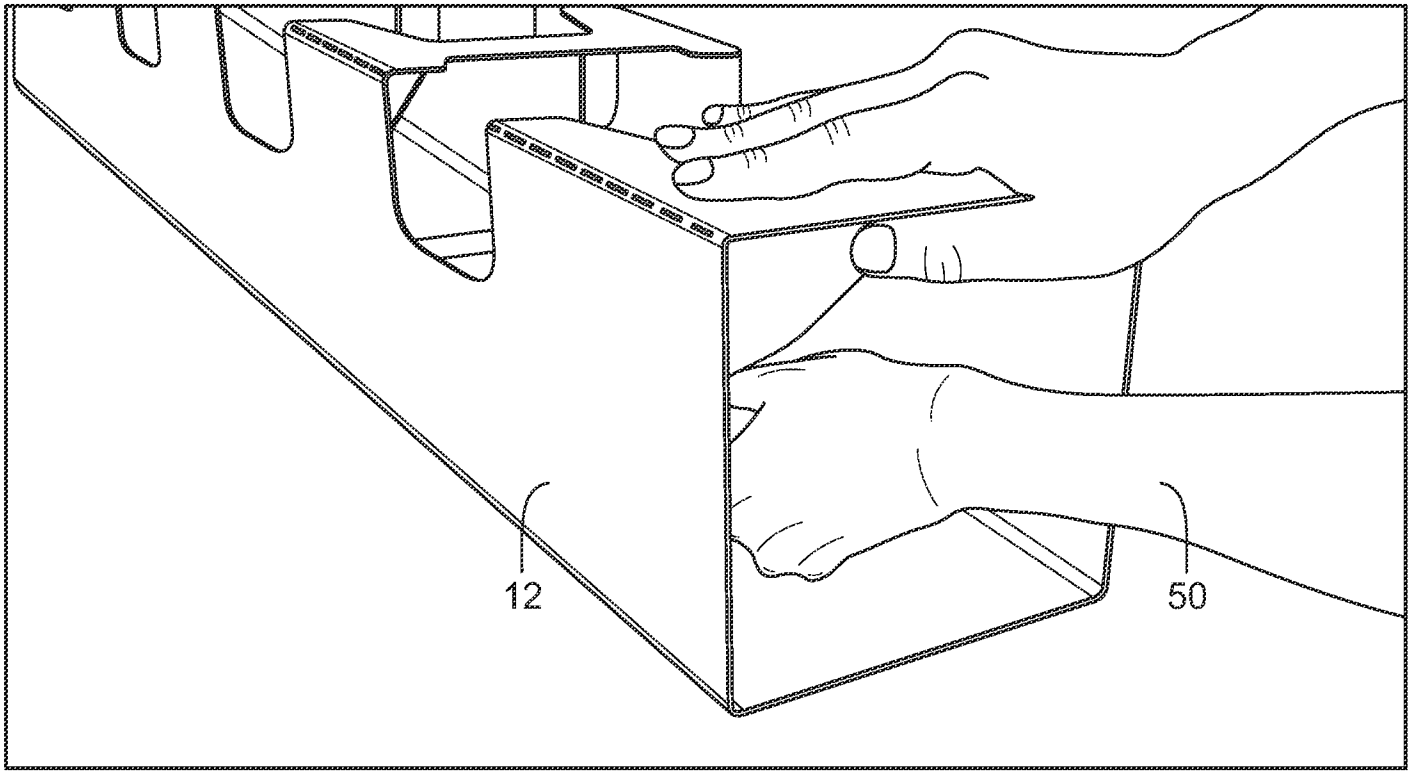

In a second step shown in FIG. 6, a user 50 pulls down the pull down panel 26 (which is located in the interior of the display 12) which pulls down the upper ends of each shelf 22, causing each shelf 22 to pivot about its hinge 24 and come to a horizontal position in the display 12 as illustrated in FIG. 1.

The present design provides about a 15% reduction in material and an 80% reduction in glue spots locations over the display of U.S. Pat. No. 10,123,635. Additionally, the complexity of the glue spots is reduced and there is a 30% increase in gluer speed and efficiency. Moreover, the present design provides a 33% reduction in assembly time which (given the approximately 16,000 displays set up per month) leads to a large savings in labor required for assembly.

As discussed, the two-step display can be formed from a single blank of material such as that shown in FIG. 2. In this instance, the panel on the far right of the drawing (which is shorter than the other panels shown) can be detached from the blank and secured to the shelves via the glue tabs (marked with "x" s) connected to the top of each shelf (the glue tabs will eventually end up against a back wall or panel of the display). The thin panel on the far left side can be glued to the panel next to the detachable panel. The display can be shipped in a flat form (two layers thick if the far left glue panel is secured to the panel next to the detachable panel) and quickly set up at its destination by forming the display to have a rectangular interior cross sectional shape (i.e., by bending the fold lines separating the panels), and pulling down the detachable panel (which is now secured to the shelves) via the handle slot shown proximate its lower edge (in this regard, the detachable panel will be in the interior of the display). In some instances, the detachable panel can be formed separately and does not necessarily need to be part of a single blank, Many modifications and variations of the present invention are possible in light of the above teachings. It is, therefore, to be understood within the scope of the appended claims the invention may be protected otherwise than as specifically described.

I claim:

1. A shelving display comprising:

a back wall panel;

a first side wall panel extending from a first side of the back wall panel;

a second side wall panel extending from a second side of the back wall panel;

a front wall panel extending between a front portion of the first side wall panel and a front portion of the second side wall panel and having a plurality of shelves hingedly attached to the front wall panel; and, a pull down panel having a height less than a height of the back wall panel, side wall panels and front wall panel, the pull down panel having a handle and is connected to each of the plurality of shelves on the front wall panel wherein movement of the pull down panel forces each of the plurality of shelves to pivot toward the back wall panel wherein the pull down panel is glued to each of the plurality of shelves.

2. The shelving display of claim 1 wherein the handle includes an opening in a lower portion of the pull down panel.

3. The shelving display of claim 1 wherein each of the plurality of shelves includes a glue tab.

4. The shelving display of claim 1 wherein the pull down panel has a height shorter than a height of the first side wall panel.

5. The shelving display of claim 1 wherein the back wall panel, the first side wall panel, the second side wall panel and the front wall panel are formed from a single sheet of material.

6. The shelving display of claim 5 wherein the pull down panel is detachably part of the single sheet of material.

7. The shelving display of claim 6 wherein the material is corrugated paper.

8. The shelving display of claim 5 further comprising a glue strip panel for connecting the second side wall panel to a first side of the back wall panel.

9. The shelving display of claim 1 wherein the first side wall panel includes a plurality of first side openings, each of the first side openings aligned with one of the plurality of shelves in the front wall panel.

10. The shelving display of claim 9 wherein the second side wall panel includes a plurality of second side openings, each of the second side openings aligned with one of the plurality of shelves in the front wall panel.

11. The shelving display of claim 1 wherein the display has a generally square cross-sectional footprint when assembled.

12. The shelving display of claim 1 further comprising a plurality of upwardly extending panels that are foldable into forming a top of the display.

13. A shelving display comprising:

a back wall panel;

a front wall panel having a plurality of shelves hingedly connected to the front wall panel;

a first side wall panel integrally connected to the back wall panel by a first fold line and to the front wall panel by a second fold line;

a second side wall panel integrally connected to the front wall panel by a third fold line; and, a pull down panel having a height less than a height of the back wall panel, side wall panels and front wall panel, the pull down panel including a handle and being connected to each of the plurality of shelves wherein the pull down panel is glued to each of the plurality of shelves.

14. The shelving display of claim 13 wherein the handle includes an opening at a first lower end of the pull down panel.

15. The shelving display of claim 13 further comprising a connecting panel integrally connected to the second side wall panel by a fourth fold line, the connecting panel glued to an edge of the back wall panel.

16. The shelving display of claim 13 wherein the back wall panel, front wall panel, first side wall panel, second side wall panel and pull down panel are formed from single blank of corrugated material.

17. The shelving display of claim 16 wherein the pull down panel is detachable from the blank.

* * * * *